US010870192B1

(12) United States Patent
Peer

(10) Patent No.: US 10,870,192 B1
(45) Date of Patent: Dec. 22, 2020

(54) PORTABLE IMPACTING APPARATUS

(71) Applicant: Shilo Peer, Artesian, SD (US)

(72) Inventor: Shilo Peer, Artesian, SD (US)

( * ) Notice: Subject to any disclaimer, the term of this patent is extended or adjusted under 35 U.S.C. 154(b) by 250 days.

(21) Appl. No.: 15/676,221

(22) Filed: Aug. 14, 2017

(51) Int. Cl.
*B25D 11/06* (2006.01)
*B25D 17/28* (2006.01)
*E04H 17/26* (2006.01)

(52) U.S. Cl.
CPC ..... *B25D 11/066* (2013.01); *B25D 17/28* (2013.01); *B25D 2216/0038* (2013.01); *B25D 2222/72* (2013.01); *B25D 2250/391* (2013.01); *E04H 17/263* (2013.01)

(58) Field of Classification Search
CPC ..... B25D 2250/391; B25D 2222/72; B25D 2216/0038; B25D 11/066; B25D 17/28; E04H 17/263
USPC ..... 173/48, 104, 94, 117, 128
See application file for complete search history.

(56) References Cited

U.S. PATENT DOCUMENTS 2,435,651 A * 2/1948 Huber ..... E04H 17/263 173/25
3,150,724 A * 9/1964 Oelkers ..... E01C 23/122 173/49
3,875,811 A * 4/1975 Fuller ..... B06B 1/166 74/61
4,439,943 A 4/1984 Brakhage
4,472,980 A * 9/1984 Wadensten ..... B01F 11/0002 366/126
5,353,465 A * 10/1994 Pierce ..... B08B 7/02 15/236.01
8,752,876 B2 6/2014 Niekamp
8,820,435 B2 9/2014 Niekamp
9,238,895 B2 1/2016 Niekamp
9,416,514 B2 8/2016 Niekamp
2012/0108402 A1* 5/2012 Rodgers, Jr. ..... A63B 21/00069 482/110
2015/0368873 A1* 12/2015 Whitaker ..... E02F 3/966 173/90
2016/0201353 A1 7/2016 Niekamp
2017/0196174 A1 7/2017 Niekamp

* cited by examiner

*Primary Examiner* — Hemant Desai
*Assistant Examiner* — Christopher Robin Kim
(74) *Attorney, Agent, or Firm* — Jeffrey A. Proehl; Woods, Fuller, Shultz & Smith, PC

(57) ABSTRACT

An impacting apparatus may include a frame, an arm movably mounted on the frame, a weight mounted on the arm to rotate about a rotation axis eccentric to a center of mass of the weight, and a weight rotation assembly rotatably mounting the weight on the arm. The rotation assembly may comprise a rotation shaft mounted on the arm and the weight, and a clutch. The apparatus may include a rotation assembly configured to rotate the rotation shaft with respect to the arm to thereby cause rotation of the weight with respect to the arm, and an impact member movably mounted on the frame and being aligned with the impact location on the arm such that the arm impacts the impact member, with the impact member having an impact surface.

20 Claims, 6 Drawing Sheets

PORTABLE IMPACTING APPARATUS

BACKGROUND

Field

The present disclosure relates to driving apparatus and more particularly pertains to a new portable impacting apparatus for creating and transferring a forceful impact to an object.

SUMMARY

In one aspect, the present disclosure relates to an impacting apparatus that may include a frame and an arm movably mounted on the frame with the arm having a proximal end mounted on the frame and a distal end being a free end and an impact location. The apparatus may also include a weight mounted on the arm and rotatable with respect to the arm about a rotation axis eccentric to a center of mass of the weight, and a weight rotation assembly rotatably mounting the weight on the arm. The weight rotation assembly may comprise a rotation shaft mounted on the arm toward the distal end and mounted on the weight toward the inboard end, and a clutch configured to cause the rotation shaft to rotate the weight and permit the weight to freely rotate with respect to the rotation shaft if a rotational speed of the weight exceeds a rotational speed of the shaft. The apparatus may further include a rotation assembly configured to rotate the rotation shaft with respect to the arm to thereby cause rotation of the weight with respect to the arm, and an impact member movably mounted on the frame and being aligned with the impact location on the arm such that the arm impacts the impact member, with the impact member having an impact surface.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
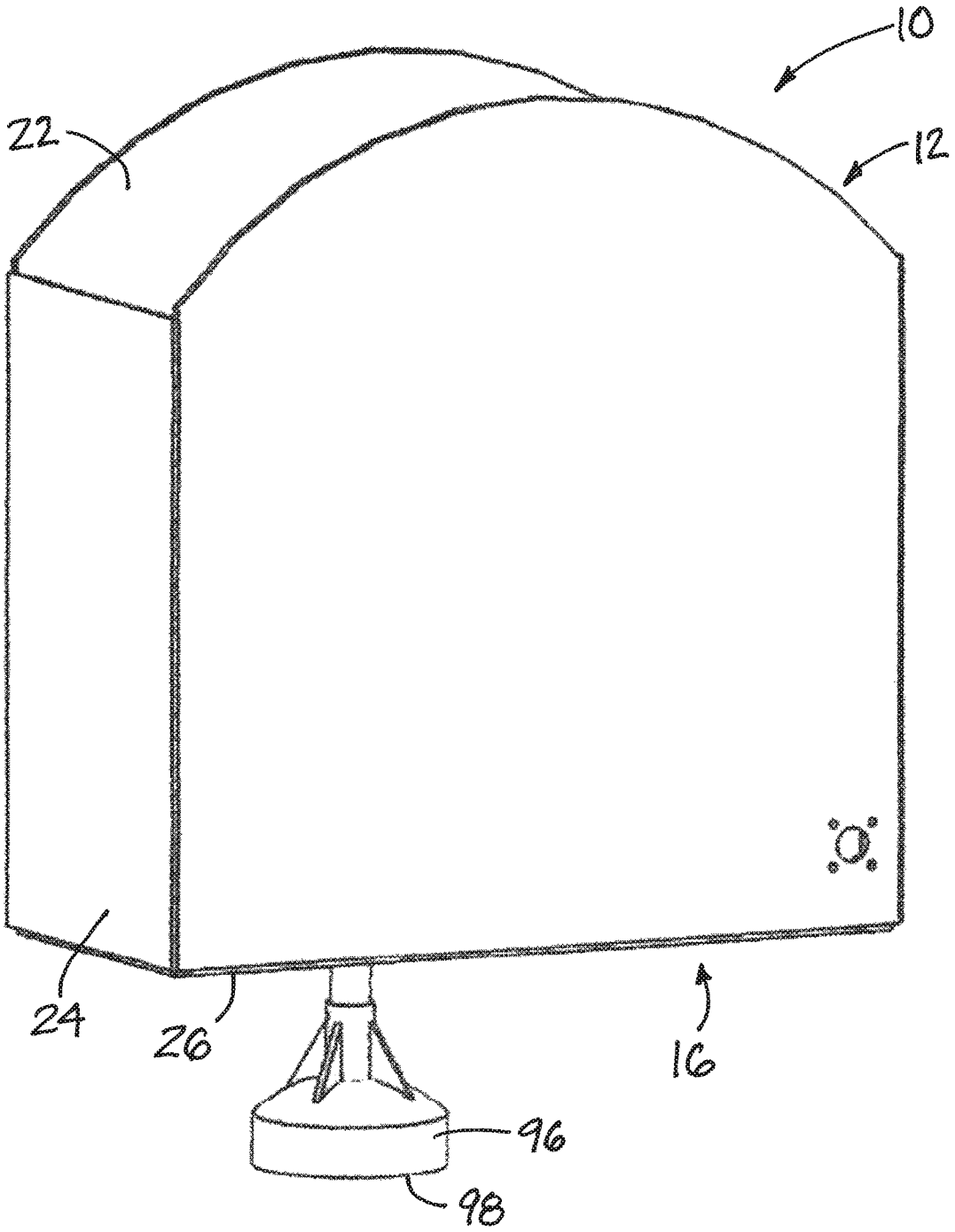
FIG. 1 is a schematic perspective view of a new portable impacting apparatus according to the present disclosure.
Figure 2:
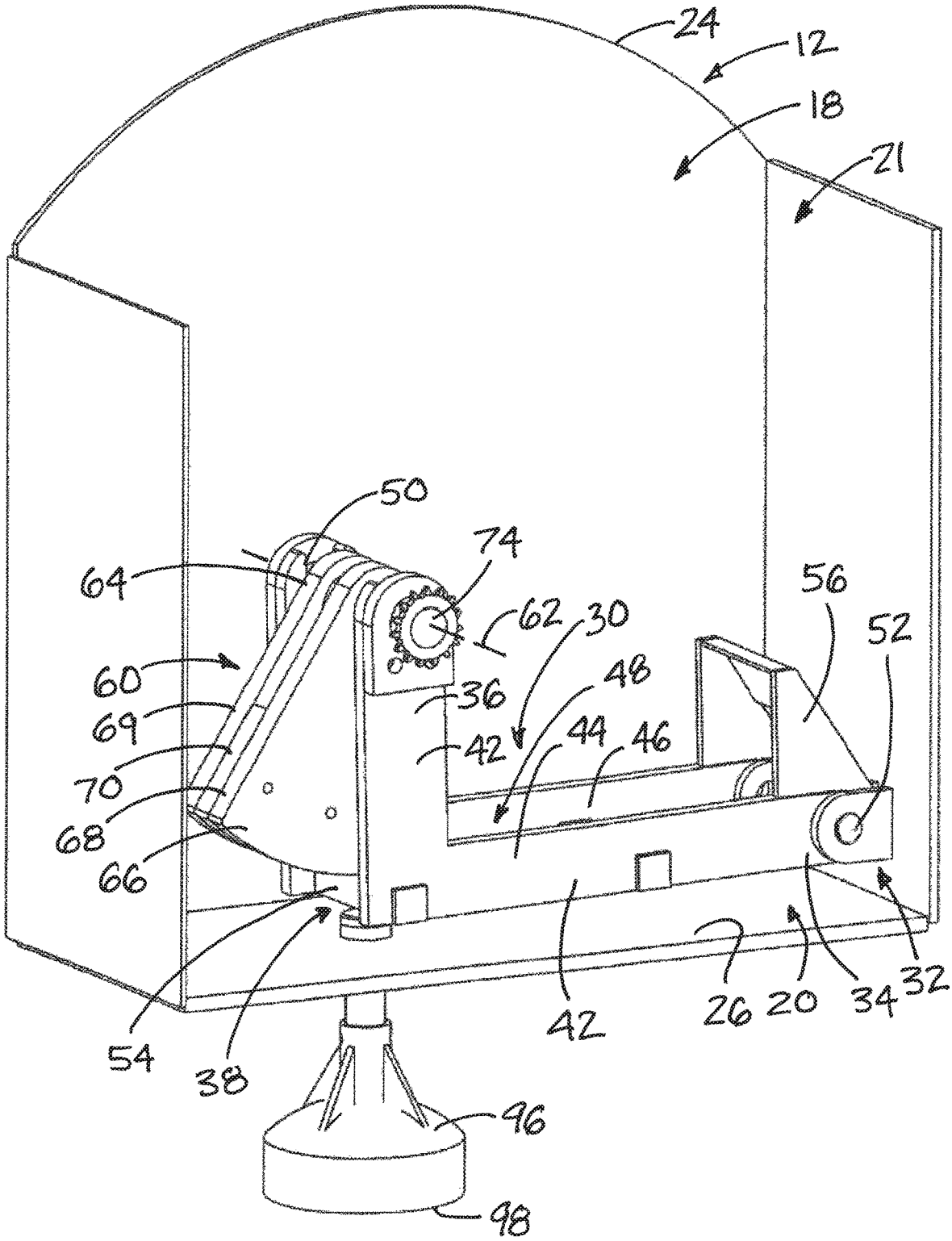
FIG. 2 is a schematic perspective view of the apparatus with a portion of the housing removed to reveal detail of the apparatus, according to an illustrative embodiment.
Figure 3:
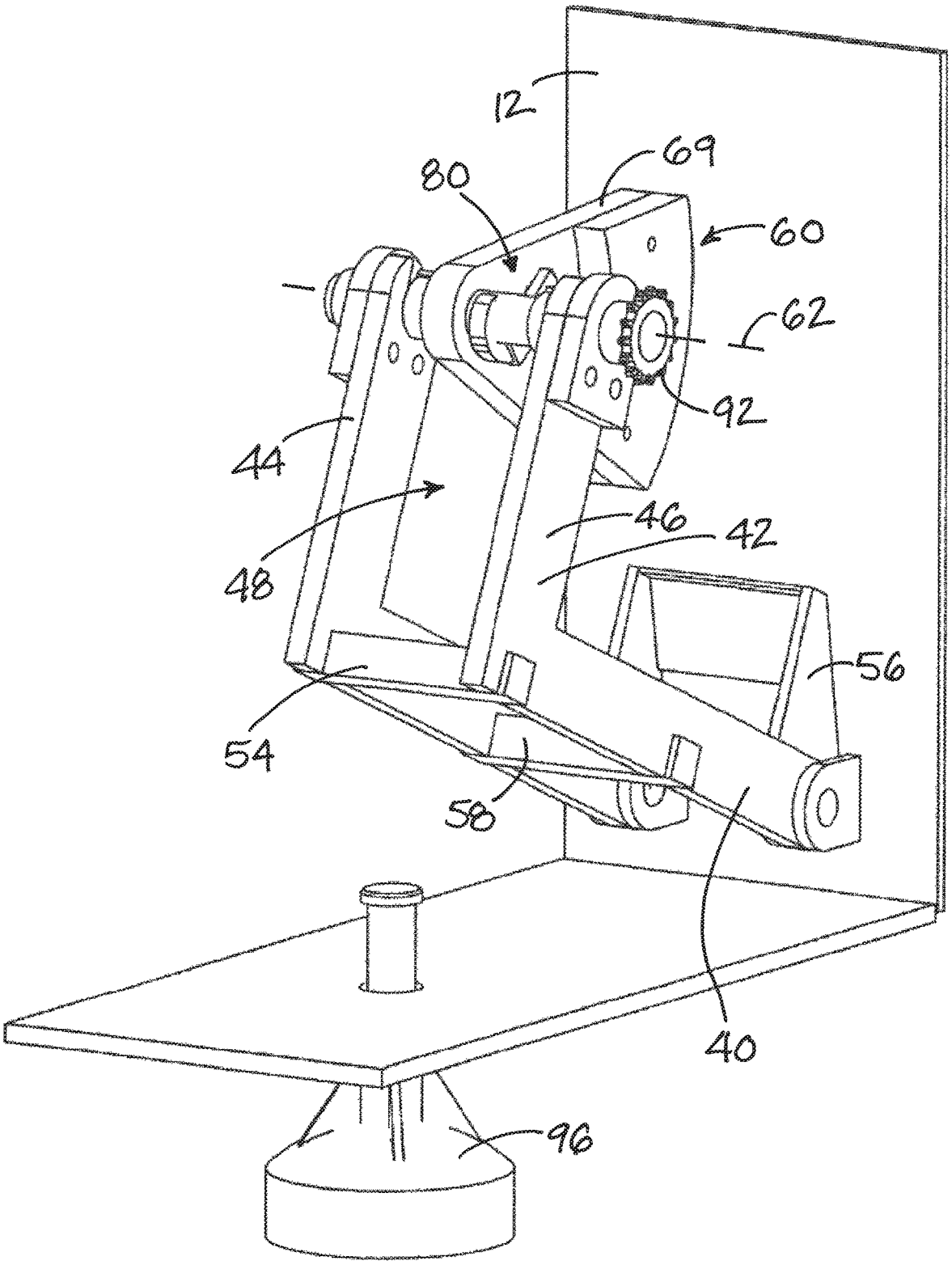
FIG. 3 is a schematic perspective view of the apparatus with portions of the housing and weight removed to reveal detail, and the arm and weight shown in a raised position prior to impacting the impact member, according to an illustrative embodiment.
Figure 4:
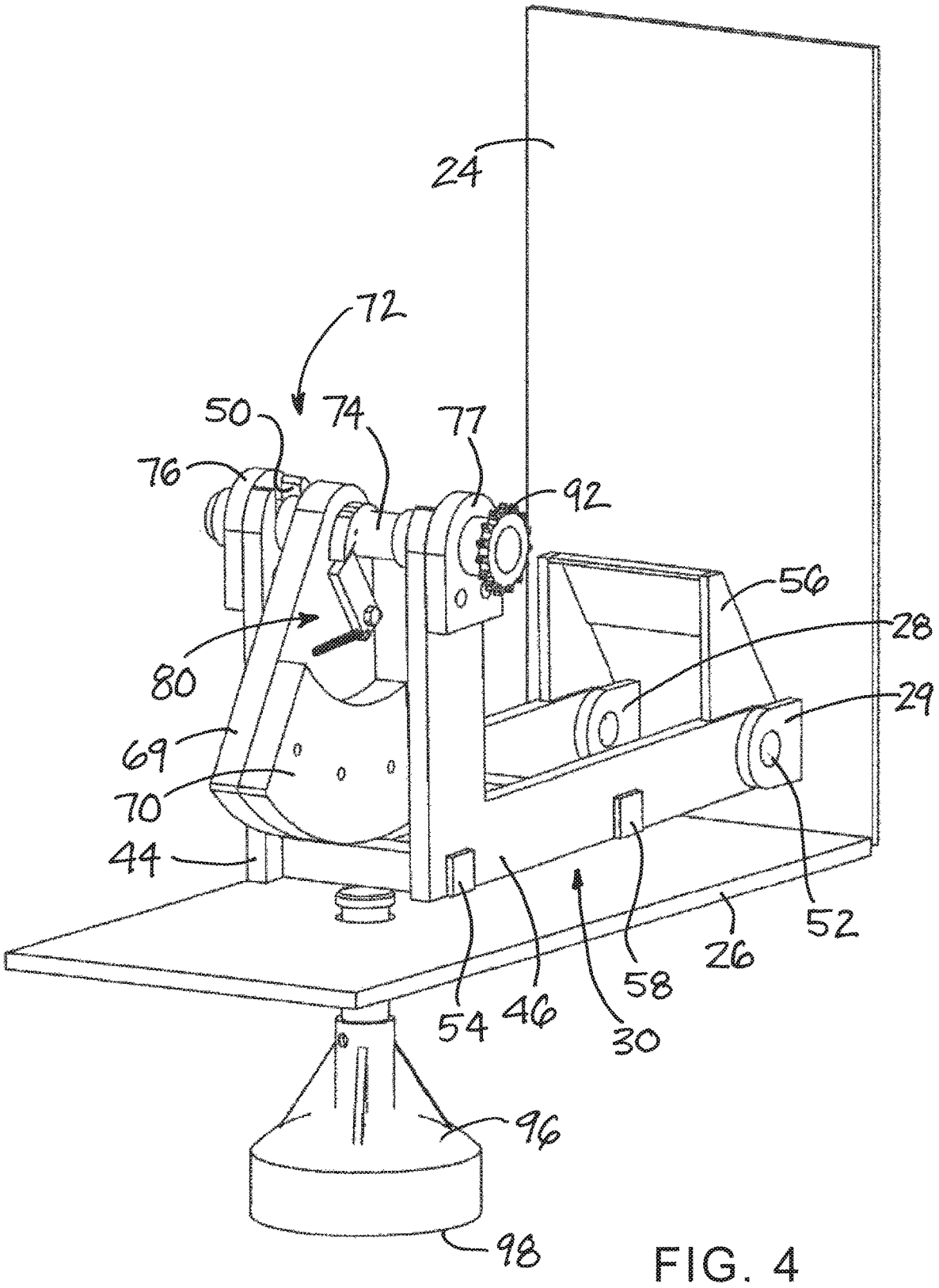
FIG. 4 is a schematic perspective view of the apparatus with portions of the housing and weight removed to reveal detail, and the arm and weight shown in a lowered position while impacting the impact member, according to an illustrative embodiment.
Figure 5:
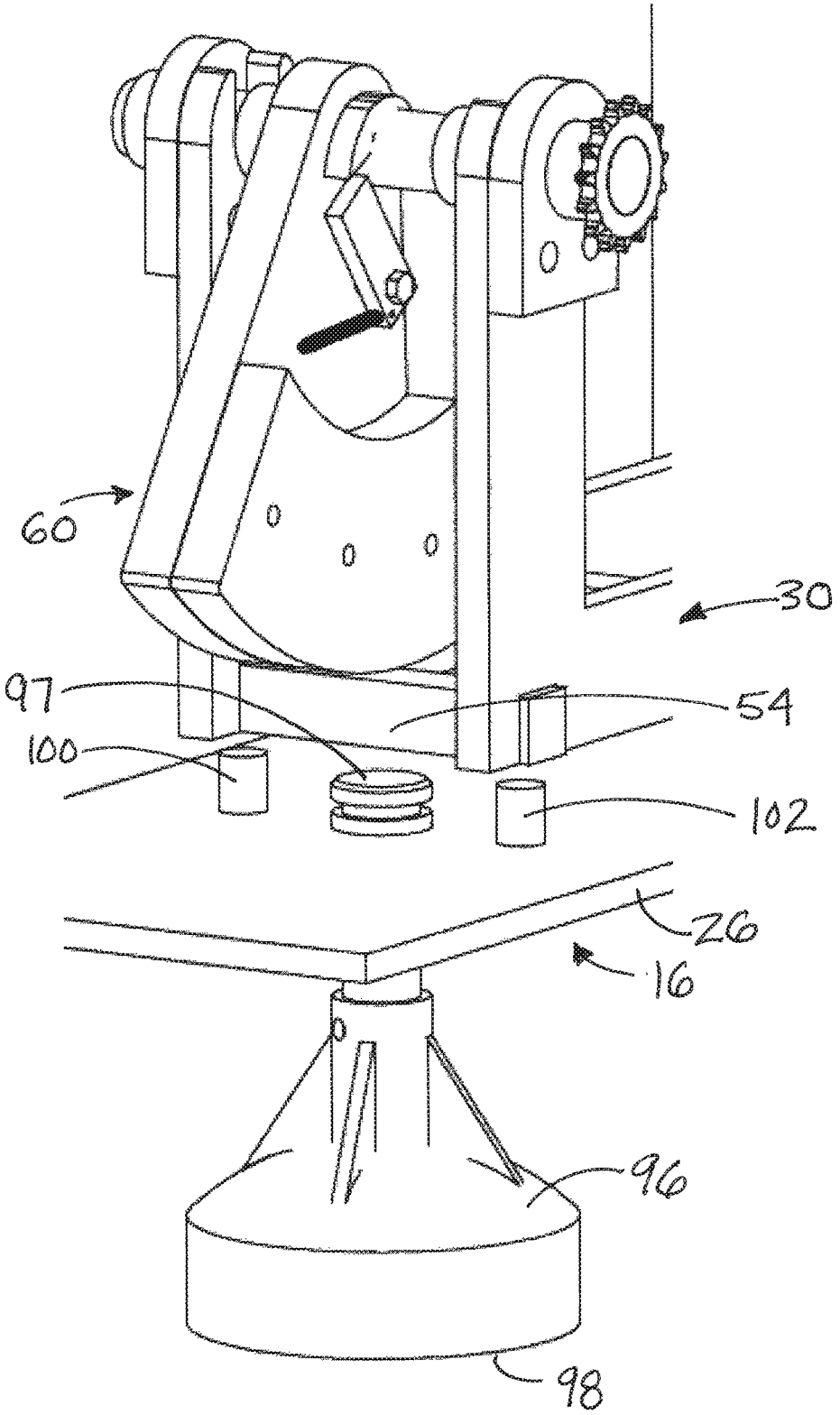
FIG. 5 is a schematic perspective view of the apparatus with portions of the housing and weight removed to reveal detail, and the arm and weight shown in a raised position prior to impacting the impact member, according to an illustrative embodiment.
Figure 6:
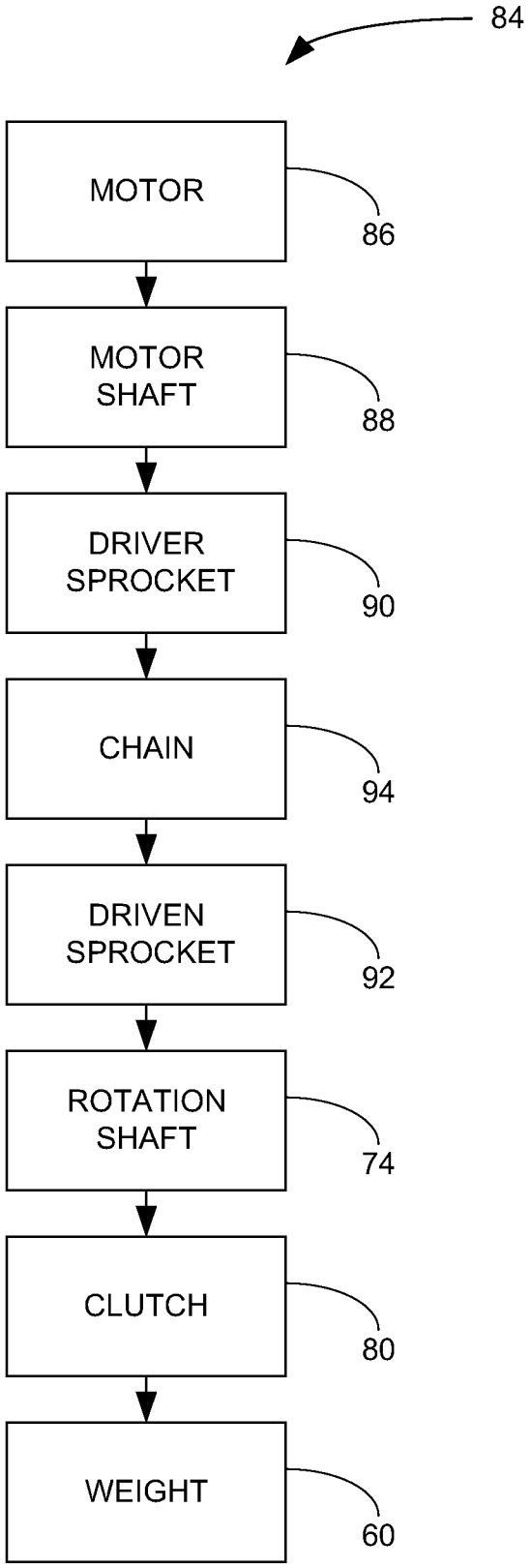
FIG. 6 is a schematic diagram of elements of the apparatus, according to an illustrative embodiment.

With reference now to the drawings, and in particular to FIGS. 1 through 6 thereof, a new portable impacting apparatus embodying the principles and concepts of the disclosed subject matter will be described.

In one aspect, the disclosure relates to an impacting apparatus 10 which may be suitable for impacting or striking or transferring a quickly applied shocking force to a structure external to the apparatus. In the illustrative example of this specification, the impacting apparatus is utilized to strike the end of a fence post to drive the opposite end of the fence post into the ground surface for installing or repairing a fence. Other illustrative applications of the apparatus include the breaking up of rock or concrete, the compaction of materials such as soil or fill material, as well as many other applications that will become apparent to one of ordinary skill in the art upon review of the disclosure. The apparatus may be used independently of other machines, but is highly suitable for mounting on any suitable supporting machinery that may allow the apparatus to be raised and lowered with respect to the article or surface to be impacted. One exemplary mounting is on the support arms of a loader or tractor.

In greater detail, the impacting apparatus 10 may include a frame 12 which may be mounted on the supporting machinery providing the transportability and adjustability of position and orientation of the apparatus. The frame 12 may define a mount or mounting by which the frame is attached to an article of machinery, such as the arm or arms of the loader. Such a mount may comprise, for example, a pair of mounting ears with holes for receiving mounting pins which also pass through elements of the machinery. In some embodiments of the apparatus 10, the frame 12 may form a housing 16 which defines and encloses an interior 18 which has a bottom 20 and a top 21. The top 21 of the interior may be closed by a top wall 22 and a perimeter wall 24 may extend downwardly from the top wall about the interior 18.

The housing may also include a bottom wall 26 closing the bottom 20 of the interior, and which may extend across the perimeter wall opposite of the top wall. The frame may include one or more mount tabs 28, 29 that extend into the interior 18 of the housing, and may be mounted on the perimeter wall 24 to extend inwardly.

The apparatus 10 may also include an arm 30 mounted on the frame, 12, and may be positioned in the interior of the housing when the frame includes a housing. The arm may be mounted to move with respect to the frame 12, and may be pivotable with respect to the frame about an arm pivot 32 between raised and lowered positions. The arm 30 may have a proximal end 34 mounted on the frame 12 by the arm pivot, and may be mounted on the one or more mounting tabs 28, 29 which extend into the housing interior. The arm 30 may also have a distal end 36 which may be free to move as the arm pivots on the pivot 32. In some embodiments, the arm 30 may include a proximal section 40 located generally toward the proximal end 34 and a distal section 42 located toward the distal end. The proximal section 40 may be substantially horizontally oriented, and the distal section 42 may be substantially vertically oriented, when the apparatus is positioned for use.

The arm 30 may include a pair of arm portions 44, 46 which may be spaced from each other by a weight space 48. The arm portions may extend substantially parallel to each other between the proximal 34 and distal 36 ends of the arm. Each of the arm portions 44, 46 may have a support groove 50 at the distal end of the arm. The arm 30 may also include an arm pivot shaft 52 for pivotally mounting the arm on the frame, and the pivot shaft 52 may be located at the proximal end 34 of the arm. The arm pivot shaft 52 may extend between the arm portions 44, 46 and pass through holes formed in the mount tabs 28, 29 of the frame 12. In some embodiments, a pair of arm pivot shaft segments may be employed rather than a single piece shaft, and each arm pivot shaft segment may pivotally mount one of the arm portions on one of the mount tabs 28, 29 of the frame.

The arm may also include an impacting member 54 which extends between the arm portions 44, 46 to form the impact location 38 of the arm, or the location on the arm that transmits impact to a relatively stationary element described elsewhere in this disclosure. The impacting member 54 may be mounted on the arm portions at about the location on the arm where the proximal and distal sections meet. The arm may further include a limit member 56 which is configured to limit movement of the arm to a predetermined degree of pivot with respect to the frame. The limit member 56 may extend from at least one of the arm portions 44. 46 to contact a portion of the frame when pivoting of the arm exceeds the predetermined degree of pivot of the arm. The limit member 56 may be located toward the arm pivot 32. The limit member 56 may extend between the arm portions and may extend upwardly from the arm portions to contact the perimeter wall 24 of the housing of the frame when pivoting of the arm reaches the predetermined degree of pivot with respect to the frame. Optionally, a brace member 58 may extend between the arm portions and may be mounted on the proximal sections of the arm portions to provide additional stabilization of the arm portions with respect to each other.

A weight 60 of the apparatus 10 may be mounted on the arm 30. The weight 60 may be rotatable with respect to the arm about a rotation axis 62 which is eccentric to the center of mass of the weight such that rotation of the weight about the rotation axis and with respect to the arm tends to cause the arm to pivot on the arm pivot 32, generally about it in an up-and-down manner. The weight 60 may have an inboard end 64 and an outboard end 66 with the inboard end being mounted on the arm 30. In some embodiments, the inboard end 64 may be smaller in at least one dimension than the outboard end 66. Illustratively, the weight 60 may include two weight plates 64, 69 with the weight plates being spaced apart to define a clutch space therebetween. A spacer plate 70 may be positioned between the weight plates toward the outboard end of the weight to create the clutch space toward the inboard end. Suitable fasteners passing through the weight and spacer plates may connect the plates together to effectively form the plates as a unit.

The apparatus 10 may also include a weight rotation assembly 72 which rotatably mounts the weight 60 on the arm 30. The weight rotation assembly may include a rotation shaft 74 which may pass through the weight and the arm. In some embodiments, the shaft 74 may pass through the inboard end 64 of the weight and through the distal end of the arm. The rotation shaft 74 may extend through the support groups 50 in the arm portions of the arm. The weight rotation assembly 72 may also include a pair of bushing assemblies 76, 77 through which the rotation shaft 74 may extend, and the bushing assemblies may mount the rotation shaft to the arm while permitting rotation of the shaft with respect to the arm. Each of the bushing assemblies may mount the rotational shaft to one of the arm portions 44, 46. Other types of suitable bearings may also be used.

The weight rotation assembly 72 may also include a clutch 80 which is configured to permit the rotation shaft 74 to rotate the weight 60 in a first rotational direction and permit the weight to freewheel or freely rotate with respect to the rotation shaft if the rotational speed of the weight should exceed the rotational speed of the shaft 74, such as when rotation of the rotation shaft 74 is slowed or stopped after a period of rotation. The clutch may be mounted on the rotation shaft 74 and the weight 60, with a portion of the clutch being keyed or secured to the rotation shaft to rotate with the shaft 74, while another portion of the clutch is secured to the weight to rotate as a unit with the weight.

The apparatus 10 may also include a rotation assembly 84 which is configured to rotate the rotation shaft 74 with respect to the arm to thereby cause rotation of the weight 60 with respect to the arm. Rotation of the rotation shaft 74 is transferred to the clutch 80 which in turn causes the weight to rotate as well, and when the rotation assembly 84 slows or stops rotation of the shaft 74 after rotating the shaft 74, further rotation of the weight is not transferred back to the rotation shaft through the clutch 80. The rotation assembly 84 may include a motor 86 which is mounted on the frame 12, and may be located exterior of the housing 16. The motor 86 may have a shaft 88 which passes through the perimeter wall of the housing if the motor is exteriorly located. A driver sprocket 90 may be positioned on the portion of the motor shaft 88 located in the housing interior 18. The motor shaft 88 may be rotatable about a common axis with the pivot shaft 52. A driven sprocket 92 may be mounted on the rotation shaft 74 to rotate with the shaft 74, and a chain 94 may be configured to transfer rotation from the driver sprocket 90 to the driven sprocket 92. The chain 94 may be entrained on the driver 90 and driven 92 sprockets to transfer the rotation and cause the rotation shaft 74 to rotate.

The apparatus 10 may also include an impact member 96 which is movably mounted on the frame 12. The impact member 96 may be substantially vertically movable, and may be slidably mounted on the frame. In some embodiments, the impact member 96 may be slidable through a hole formed in the bottom wall 26 of the housing of the frame. The impact member may be positioned so as to be aligned with the impact location 38 on the arm, and, for example, the upper end 97 of the impact member is substantially vertically aligned with the impacting member 54 of the arm. The impact member 96 may have an impact surface 98 for contacting the structure to which transfer of an impact is desired. In some embodiments, the impact surface may be substantially concave in shape to capture the end of an object to be driven, such as a fence post. In other embodiments, the impact surface may be substantially convex in shape to focus the force, such as for breaking up rock or concrete. In still other embodiments, the impact surface may be substantially planar to spread out the force, such as for compacting soil or other granular material.

The apparatus may also include structure to avoid or mitigate a "dry fire" situation in which the impact surface of the impact member 96 is not engaged with an object when the apparatus is operated and the impact location on the arm would otherwise contact the impact member with significant force. One or more dry fire elements 100, 102 may be positioned on the frame, such as on the bottom wall of the housing adjacent to the upper end of the impact member, to receive the impact from the arm rather than the impact member. Illustratively, when the impact surface of the impact member is not engaged with an object and the weight of the apparatus pressing downwardly does not cause the upper end of the impact member to rise up in the interior of the housing, the upper end of the impact member may extend through the bottom wall at a height that is less than the height of the one or more dry fire elements, so that the arm moving downwardly toward the impact member comes into contact with the dry fire elements instead of contacting the impact member and is thus prevented from impacting the upper end of the impact member.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. An impacting apparatus comprising:

a frame;

an arm movably mounted on the frame, the arm having a proximal end mounted on the frame and a distal end being a free end, the arm having an impact location;

a weight mounted on the arm and rotatable with respect to the arm about a rotation axis eccentric to a center of mass of the weight;

a weight rotation assembly rotatably mounting the weight on the arm, the weight rotation assembly comprising:

a rotation shaft mounted on the arm at the distal end and mounted on the weight;

a clutch configured to transfer rotation of the rotation shaft to the weight if a rotational speed of the rotation shaft exceeds a rotational speed of the weight and permit the weight to freely rotate with respect to the rotation shaft if the rotational speed of the weight exceeds the rotational speed of the rotation shaft;

a rotation assembly configured to rotate the rotation shaft with respect to the arm to thereby cause rotation of the weight with respect to the arm; and an impact member movably mounted on the frame and being aligned with the impact location on the arm such that the arm impacts the impact member, the impact member having an impact surface;

wherein the impact member has an impact surface configured to contact an object to which transfer of an impact is desired, the impact surface having a substantially concave shape to capture a portion of an end of the object to be driven.

2. The impacting apparatus of claim 1 wherein the frame comprises a housing defining an interior and having a top wall, a bottom wall, and a perimeter wall extending between the top and bottom walls; and wherein the arm, the weight, and the weight rotation assembly are located in the interior of the housing and the housing is configured such that the weight is able to rotate eccentrically within the interior of the housing.

3. The impacting apparatus of claim 1 wherein the arm comprises a pair of arm portions extending substantially parallel to each other between the proximal end and the distal end of the arm.

4. The impacting apparatus of claim 3 wherein the arm includes an arm pivot shaft located at the proximal end of the arm, the arm pivot shaft pivotally mounting the arm on the frame.

5. The impacting apparatus of claim 3 wherein the pair of arm portions are spaced from each other to define a weight space in which the weight is at least partially positioned.

6. The impacting apparatus of claim 1 wherein the arm includes a limit member configured to limit the arm to a predetermined degree of pivot of the arm with respect to the frame.

7. The impacting apparatus of claim 6 wherein the limit member of the arm is configured to contact a portion of the frame when the arm reaches the predetermined degree of pivot of the arm with respect to the frame.

8. The impacting apparatus of claim 1 wherein the arm comprises a proximal section and a distal section, the proximal section being located at the proximal end of the arm and the distal section being located at the distal end of the arm, the proximal section being substantially horizontally oriented, the distal section being substantially vertically oriented.

9. The impacting apparatus of claim 1 wherein the arm comprises a pair of arm portions extending substantially parallel to each other between the proximal end and the distal end of the arm; and wherein the weight rotation assembly includes a pair of bushing assemblies mounting the rotation shaft to the pair of arm portions, the bushing assemblies being removably mounted on the arm portions.

10. The impacting apparatus of claim 1 wherein the rotation assembly comprises:

a motor mounted on the frame and having a motor shaft with a driver sprocket mounted on the motor shaft to rotate with the motor shaft;

a driven sprocket mounted on the rotation shaft to rotate with the rotation shaft; and a chain configured to transfer rotation of the driver sprocket to the driven sprocket.

11. The impacting apparatus of claim 1 wherein the weight has an inboard end and an outboard end, the inboard end being smaller in at least one dimension than the outboard end such the center of mass is closer to the outboard end than the inboard end; and wherein the rotation shaft is mounted on the weight at the inboard end.

12. The impacting apparatus of claim 1 wherein the rotation axis of the weight is substantially vertically aligned with the impact location on the arm when the impact location on the arm is in contact with the impact member.

13. The impacting apparatus of claim 1 wherein the rotation axis of the weight is positioned above a location on the arm relatively closer to the distal end of the arm than the proximal end of the arm when the arm is in a substantially horizontal orientation.

14. The impacting apparatus of claim 1 wherein the frame comprises a housing enclosing and defining an interior; and wherein the arm, the weight, and the weight rotation assembly are located in the interior of the housing, the impact member extending between the interior and an exterior of the housing.

15. The impacting apparatus of claim 1 wherein the frame comprises a housing including a top wall, a bottom wall, and a perimeter wall extending between the top and bottom walls to define an interior of the housing, the proximal end of the arm being mounted at the perimeter wall.

16. The impacting apparatus of claim 1 wherein the impact member extends through an aperture formed in the housing, the impact member having an upper end with a radial flange blocking movement of the upper end of the impact member through the aperture, the impact member having a lower end with a diameter blocking movement of the lower end of the impact member through the aperture.

17. An impacting apparatus comprising:

a frame;

an arm movably mounted on the frame, the arm having a proximal end mounted on the frame and a distal end being a free end, the arm having an impact location;

a weight mounted on the arm and rotatable with respect to the arm about a rotation axis eccentric to a center of mass of the weight;

a weight rotation assembly rotatably mounting the weight on the arm, the weight rotation assembly comprising:

a rotation shaft mounted on the arm at the distal end and mounted on the weight;

a clutch configured to transfer rotation of the rotation shaft to the weight if a rotational speed of the rotation shaft exceeds a rotational speed of the weight and permit the weight to freely rotate with respect to the rotation shaft if the rotational speed of the weight exceeds the rotational speed of the rotation shaft;

a rotation assembly configured to rotate the rotation shaft with respect to the arm to thereby cause rotation of the weight with respect to the arm; and an impact member movably mounted on the frame and being aligned with the impact location on the arm such that the arm impacts the impact member, the impact member having an impact surface;

wherein the weight includes two weight plates rotated by the weight rotation assembly in a same rotational direction and being spaced to define a clutch space therebetween, at least a portion of the clutch being positioned in the clutch space.

18. The impacting apparatus of claim 17 wherein the weight includes a spacer plate positioned between the weight plates to form the clutch space.

19. The impacting apparatus of claim 17 wherein the impact member has an impact surface configured to contact an object to which transfer of an impact is desired, the impact surface having a substantially concave shape to capture a portion of an end of the object to be driven.

20. An impacting apparatus comprising:

a frame;

an arm movably mounted on the frame, the arm having a proximal end mounted on the frame and a distal end being a free end, the arm having an impact location;

a weight mounted on the arm and rotatable with respect to the arm about a rotation axis, a center of mass of the weight being offset from the rotation axis, the center of mass of the weight rotating about the rotation axis in a substantially circular path;

a weight rotation assembly rotatably mounting the weight on the arm, the weight rotation assembly comprising:

a rotation shaft mounted on the arm at the distal end and mounted on the weight, the rotation shaft rotating on the rotation axis of the weight;

a clutch configured to transfer rotation of the rotation shaft to the weight if a rotational speed of the rotation shaft exceeds a rotational speed of the weight and permit the weight to freely rotate with respect to the rotation shaft if the rotational speed of the weight exceeds the rotational speed of the rotation shaft;

a rotation assembly configured to rotate the rotation shaft with respect to the arm to thereby cause rotation of the weight with respect to the arm; and an impact member movably mounted on the frame and being aligned with the impact location on the arm such that the arm impacts the impact member, the impact member having an impact surface, the impact member being elongated along a substantially vertically oriented longitudinal axis of the impact member;

wherein the longitudinal axis of the impact member intersects the rotation axis of the weight and of the rotation shaft;

wherein the impact member has an impact surface configured to contact an object to which transfer of an impact is desired, the impact surface being bisected by the longitudinal axis of the impact member; and wherein the longitudinal axis of the impact member intersects the substantially circular path of the center of mass of the weight.

* * * * *